United States Patent [19]

Alexy

[11] 4,372,055

[45] Feb. 8, 1983

[54] THERMAL INSULATION END PANEL MOUNTING BRACKET ASSEMBLY FOR PAPER MACHINE DRYER CYLINDER

[75] Inventor: Fred H. Alexy, Glens Falls, N.Y.

[73] Assignee: AMG Industries, Inc., Glens Falls, N.Y.

[21] Appl. No.: 259,778

[22] Filed: May 1, 1981

[51] Int. Cl.[3] ..... F26B 13/08

[52] U.S. Cl. ..... 34/110; 165/89; 165/146

[58] Field of Search ..... 34/108, 110; 24/243 B; 85/32 K; 151/41.74, 41.76, 44; 165/89, 146, 185; 100/93 RP; 29/110, 118, 119; 162/207, 375, 378, 379; 432/10, 60, 253; 411/373, 374

[56] References Cited

U.S. PATENT DOCUMENTS 4,241,518 12/1980 Alexy ..... 34/110

4,321,759 3/1982 Gamble ..... 165/146

*Primary Examiner*—Larry I. Schwartz

*Attorney, Agent, or Firm*—Sughrue, Mion, Zinn, Macpeak & Seas

[57] ABSTRACT

A metal bar is fixedly clamped by a U-bolt or similar member to the periphery of a dryer bolt head protruding outwardly of a paper machine dryer cylinder end panel. The metal bar bears one or more threaded studs which project from the face of the bar for projection through a thermal insulation end panel to fix the panel to the end face of the dryer cylinder to reduce heat loss axially of the cylinder. In one form, a sheet metal locator plate fitted between circumferentially spaced bolts bears an oblique metal bar carrying one or more studs, eliminating the need for U-bolt mounting of the metal bar to more than one bolt head.

8 Claims, 11 Drawing Figures

FIG. 1
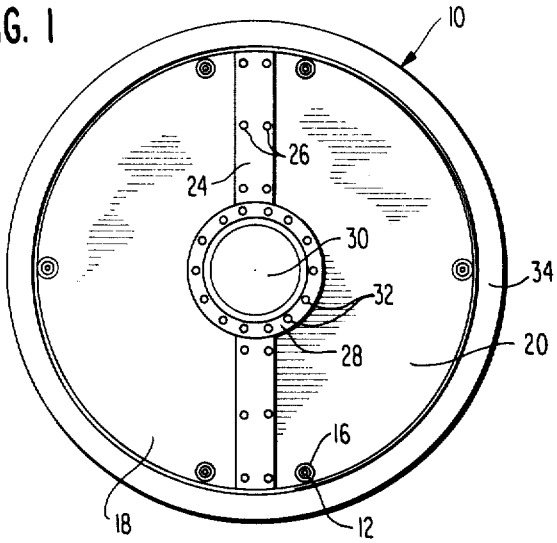
FIG. 2
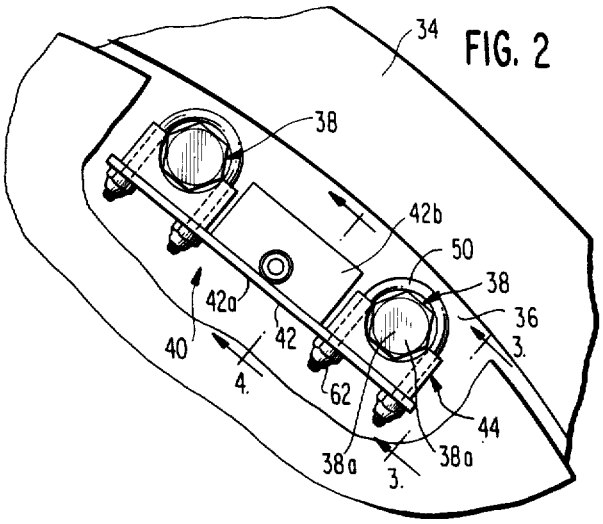
FIG. 5
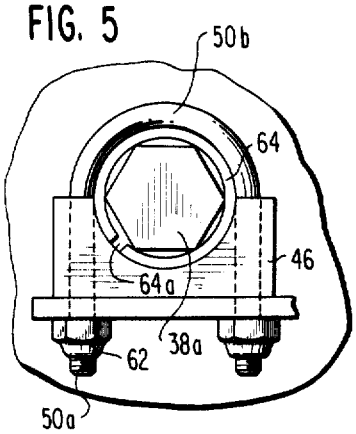
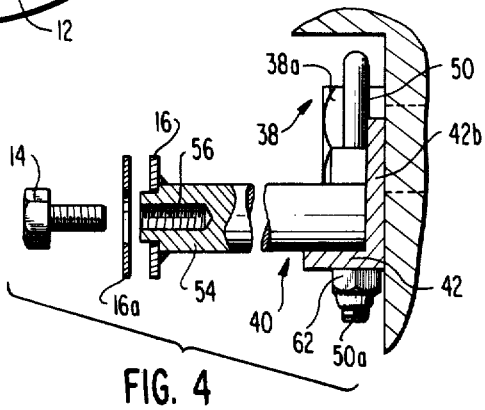
FIG. 4
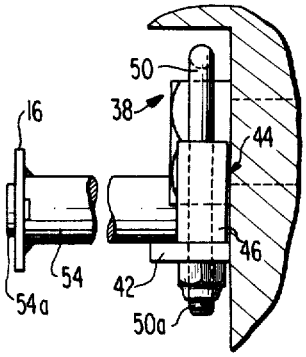
FIG. 3
FIG. 6
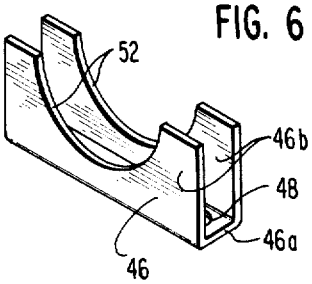
FIG. 8
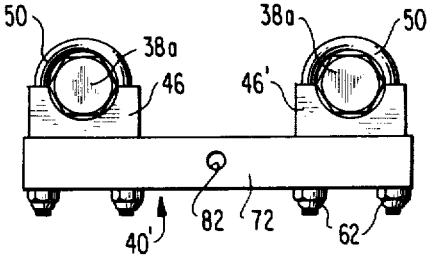
FIG. 7
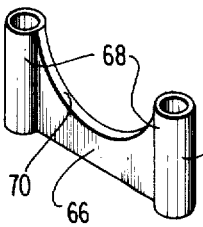
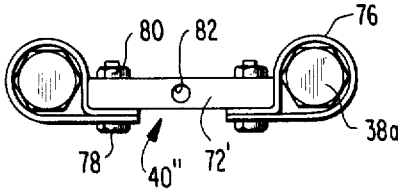
FIG. 9

FIG. 10
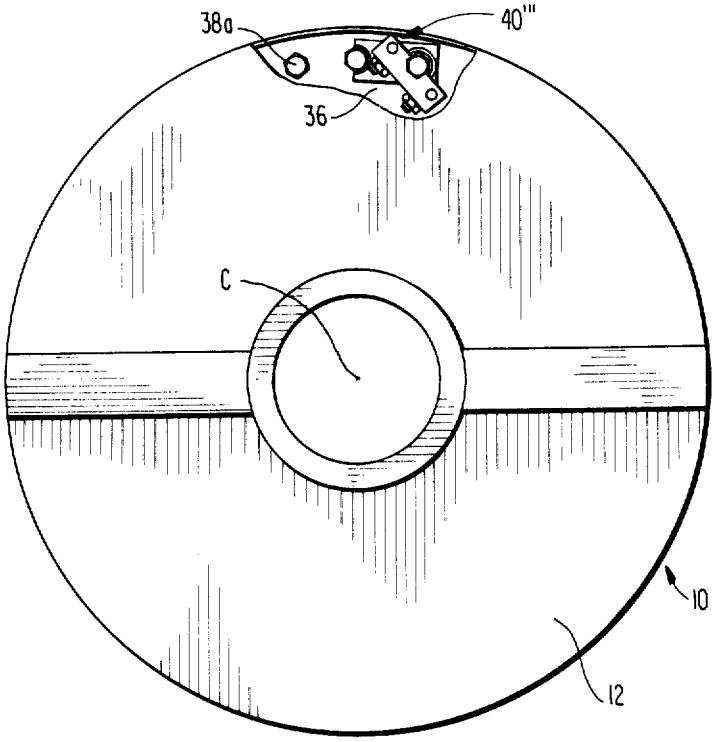
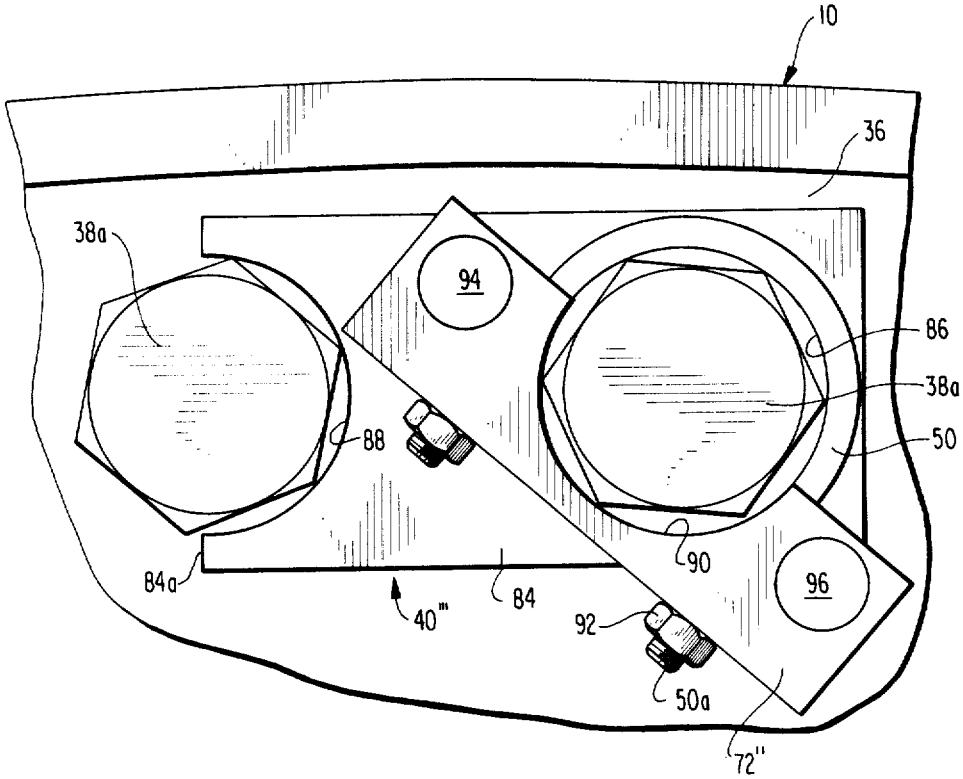
FIG. 11

THERMAL INSULATION END PANEL MOUNTING BRACKET ASSEMBLY FOR PAPER MACHINE DRYER CYLINDER

FIELD OF THE INVENTION

This invention relates to the mounting of thermal insulation material end panels to the axial end faces of a heatable dryer cylinder for drying a paper web or the like passing over the periphery of the dryer, and more particularly, to a mounting bracket arrangement spanning multiple dryer cylinder head bolts to which bracket, the planar insulation material end panel is in turn bolted.

BACKGROUND OF THE INVENTION

The applicant has successfully mounted an annular thermal insulation end panel assembly to the end bell of a paper machine dryer cylinder through the use of individual stud clamps which project from the inside face of the insulation panel and which terminate in a slotted arcuate body. A screw spans the slot to reduce the diameter of a central opening within the body and within which the dryer bolt head is clamped, to thereby fix the panel to the end face of the dryer. By utilizing a series of such stud clamps, circumferentially spaced about the end panel and being coupled individually to the protruding heads of the dryer head bolts they function to mount disc like insulation panels to end bells of the dryer cylinder. Applicant's prior construction is illustrated in U.S. Pat. No. 4,241,518 issuing Dec. 30, 1980, and entitled "Thermal Insulation Panel Assembly for a Paper Machine Dryer Cylinder and Stud Clamp Therefor".

While mounting arrangements for mounting the end panel to the axial end face of a heatable dryer cylinder functions to substantially reduce thermal energy loss axially of the cylinder, and while this arrangement provides a positive frictional locking arrangement for insuring retention of the panel on the cylinder regardless of the speed of rotation of the cylinder during use, such an arrangement requires close matching of the clamp size to the size of the existing bolt heads, thereby eliminating the possibility of using the clamps on somewhat oversized or undersized bolt heads.

It is, therefore, a primary object of the present invention to provide an improved thermal insulation material end panel assembly which may be more easily mounted and removed from the dryer assembly, and wherein the end panel assemblies may be applied to dryer cylinders having bolt heads of varying size, and wherein location of the studs may be accurately effected to insure proper alignment between each thermal insulation material end panel disc and its mounting structure.

It is a further object of the present invention to provide such an improved thermal insulation material end panel assembly in which an insulation panel is quickly and securely bracket mounted to the end bells of a heatable dryer cylinder with high rigidity to prevent distortion of the panel during rotation of the dryer cylinder.

It is a further object of the present invention to provide economy of clamp manufacture by using existing manufacturing techniques applied to the insulation material end panel mounting assembly, providing for unlimited alternate stud locations whose position can be accurately and repeatedly determined by combining two cylinder head bolts and relating the said location to these bolts.

SUMMARY OF THE INVENTION

The invention is directed to an end panel mounting bracket assembly for mounting a planar thermal insulation panel onto an exposed end of a paper dryer drum or cylinder. Dryer head end bells are carried on respective ends of the cylinder and are bolted thereto by a plurality of drum head bolts at spaced circumferential positions along said end bells with the bolt heads projecting from the face of the end bells. Each mounting bracket assembly comprises an elongated bracket member spanning between two spaced bolt heads, at least one clamp member fixed to said bracket member and surrounding one of the bolt heads and being frictionally gripped thereabout and means for detachably fixedly mounting said panel within the end of said cylinder and to one of said members.

The bracket member in one form comprises an angle bar extending beyond the bolt head and formed of a base and an integral right angle flange portion. The base is longer than the distance between the bolt heads and the flange portion is at the center of the angle bar and of a length less than the distance between the bolt heads and is interposed therebetween. A pair of "U" bolt and saddle assemblies are carried by the face to opposite sides of the flange portion. A stud is fixedly mounted to the angle bar and projects outwardly of the flange portion, at right angles thereto, for projection through the panel, and through means are threaded to the stud remote from the flange portion for locking the panel to the stud.

In an alternate embodiment, the bracket member may comprise an elongated, parallelepiped metal bar having a length in excess of the distance between the spaced bolt heads. A pair of "U" bolt and saddle assemblies may be mounted to the bar to frictionally grip respective bolt heads at respective ends of the bar. The bar preferably includes at least one tapped hole therein, and a screw is threaded to the tapped hole and interposed between and projects through the end panel and into the bar for fixing the end panel to the face of the bar bearing the tapped hole. The clamp member may comprise a pipe clamp including a saddle member bearing an arcuate recess within an edge thereof opposite an edge thereof in contact with the elongated bracket member, and a U-bolt borne by the saddle member projects therethrough and through the elongated bracket member, with the U-bolts having threaded ends and nuts threaded on the ends of the U-bolt. A split ring spacer may be interposed between the bolt head, the U-bolt and the saddle member to permit the end panel mounting bracket assembly to be mounted to bolt heads of different diameter.

In another form, the elongated bracket member may comprise a sheet metal locater plate bearing a circular hole within one end thereof sized to the diameter of the one bolt head and receiving the one bolt head. The sheet metal locater plate terminates at its opposite end in a semi-circular recess along its edge, the recess being sized to the diameter of another bolt head and receiving a portion of the other bolt head. A metal bar is fixedly mounted to the sheet metal locater plate at an angle thereto and bears a semi-circular recess corresponding to the hole within the locater plate and being aligned therewith such that the semi-circular hole within the bar receives along with the hole within the locater plate a portion of the one bolt head. A U-bolt mounted to the bar and including a curved base portion aligned with the semicircular hole within the bar and having legs projecting through the bar to opposite sides of the semicircular hole, terminates in threaded ends with nuts borne on the threaded ends so as to clamp the U-bolt and the bar to the one bolt head. A pair of studs fixedly mounted to the bar on a face thereof and axially parallel with the semi-circular hole therein and projectable through holes within the end panel, function in conjunction with the sheet metal locater bar to fix mounting holes at two different radial positions within the end panel at a position determined by the dryer head bolts carried by the paper dryer drum.

In a further embodiment, elongated bracket member may comprise a beveled bar of parallelepiped form having a length less than the distance between spaced bolts heads, and the bar has holes therethrough at opposite ends thereof, with metal strip loops surrounding the respective bolt heads and having ends projecting therefrom with holes within respective ends of the strip and the loop strip being bolted via the holes therein to respective ends of the bar for frictionally gripping the bolt heads to respective sides thereof. A tapped and threaded hole within the bar, intermediate of its ends at right angles to the holes bearing the bolts and nuts and on a face facing away from the ends of the bolt heads, bears a screw which is threaded to the tapped and threaded hole and projects through the end panel, pressing the end panel against the face of the bar to fixedly lock the end panel to the dryer head end bell.

BRIEF DESCRIPTION OF THE DRAWINGS

FIG. 1 is an end view of a paper machine dryer cylinder bearing a thermal end panel supported by mounting bracket assemblies forming one embodiment of the present invention.

FIG. 2 is an enlarged, end view of a portion of the paper machine dryer cylinder of FIG. 1 and the thermal end panel illustrating the bracket mounting arrangement of the present invention.

FIG. 3 is a sectional view of a portion of the assembly of FIG. 2 taken about line 3—3.

FIG. 4 is a sectional view of a portion of the assembly of FIG. 2 taken about line 4—4.

FIG. 5 is an elevational view of a portion of the panel mounting bracket assembly forming an alternate embodiment of the present invention.

FIG. 6 is a sheet metal saddle forming a component of the panel mounting bracket assembly of FIG. 5.

FIG. 7 is a perspective view of an offset cast metal saddle forming a component of yet a further embodiment of the present invention.

FIG. 8 is a front elevational view of yet another embodiment of the panel mounting bracket assembly for mounting a thermal end panel.

FIG. 9 is a front elevational view of yet a further embodiment of the panel mounting bracket assembly of the present invention.

FIG. 10 is an end view, partially broken away, of a paper machine dryer cylinder bearing a further embodiment of an improved panel mounting bracket assembly for mounting a thermal end panel to said cylinder.

FIG. 11 is an enlarged end view of a portion of the dryer head illustrated in FIG. 10 showing the details of the mounting bracket assembly for a thermal end panel.

DESCRIPTION OF THE PREFERRED EMBODIMENTS

Referring to the drawings, FIGS. 1 through 4 inclusive illustrate one embodiment of an end panel mounting bracket assembly employed in mounting an insulated end panel to a dryer drum or the like. In that respect, FIG. 1 illustrates a dryer drum or cylinder as at 10 to which a thermal insulation end panel indicated generally at 12 is fixedly mounted by means of six studs which project outwardly and through end panel 12 at circumferentially spaced positions, the studs bearing mounting screws 14 and washers 16 which function to lock the end panel 12 of disclike form to the end of drum or cylinder 10. In all respects, the end panel 12 is similar to the segmented end panel of my prior patent, the panel comprising an assembly of two arcuate thermal panel sections or halves as at 18 and 20 having edges which abut each other and which edges are joined by covers 24. The covers 24 are bolted to panel sections by bolts 26 which project through the section halves 18 and 20. Normally, such drums or cylinders 10 rotate about their axis by way of a central shaft as at 30. The panel sections include circular cut outs at their centers to permit the shaft 30 or the hub of the drum end bell to project therethrough. A seal ring 28 is applied to the joined sections 18 and 20 by means of bolts or screws 32 to assist in thermally sealing off the end bells at the hubs and preventing the loss of heat axially from the ends of the drum. Drum 10 is subjected to a relatively large temperature to function in the paper making process to which the drum 10 has application. The end panel 12 may comprise a thermal insulation core member sandwiched between sheet metal covers. The drum 10 in the manner of U.S. Pat. No. 4,241,518 is formed of a cylindrical body 34 to the ends of which are bolted end bells as at 36, FIG. 2, by way of dryer head bolts indicated generally at 38. The dryer head bolts have bolt heads 38*a* of hexagonal configuration projecting outwardly from the axial end face of the end bell 36. The bolts are circumferentially spaced about the periphery of the drum end bell, normally with uniform spacing therebetween.

Instead of the stud clamps which are employed in mounting the thermal insulation panels to the ends of the paper machine dryer cylinder or drum of my prior U.S. Pat. No. 4,241,518, the present invention is directed to a dryer drum insulation end panel mounting bracket assemblies. One assembly indicated generally at 40, FIG. 2, forms one embodiment of the present invention. A number of these mounting bracket assemblies are employed to mount end panel 12 to the end of the drum or cylinder 10. As may be appreciated, a second panel is mounted to the opposite end of drum 10.

In the illustrated embodiment of FIG. 1, six such mounting bracket assemblies 40 are employed, three for each panel section 18 and 20. In that respect, an angle bar or bracket member 42 includes a flat, thin strip form base 42*a* and an integral, right angle flange portion 42*b*, at the center thereof and extending longitudinally along only a portion of base 42*a*. Clamps 44 are mounted to the angle bar or bracket 40, respectively, at each end of base 42*a* and to the side of flange 42*b*. The clamp indicated generally at 44, comprises a saddle or saddle member 46, one form of which may be seen in FIG. 6, the saddle member 46 being U-shaped in form including a base 46*a* and laterally opposed right angle walls 46*b*. Holes are provided at 48 within the base through which project the end of a U-bolt 50, formed of a wire rod and being threaded as at 50*a* at respective ends. The saddle member 46 is formed such that the opposed walls 46*b* are provided with circular cut outs as at 52 corresponding to the diameter of the bolt heads 38*a* within which the bolt head is positioned when the bracket assembly 40 is mounted to the drum end bell.

In the embodiment of FIGS. 1 through 4, the angle bar or bracket member 42 has welded thereto a cylindrical rod or stud 54, for maximum rigidity and strength, with the end of the stud 54 abutting the face of flange portion 42*b* and the stud periphery near that end abutting the surface of base 42*a*. The periphery of the stud or bore 54, at its free end, is recessed to provide a reduced diameter portion 54*a*. Further, the free end is tapped and threaded as at 56. The reduced diameter portion 54*a* receives a washer 16A whose internal diameter is slightly larger than that of reduced diameter portion 54*a* of stud 54. The washer 16 is fixedly attached to the stud 54. The screw 14 and the washer 16 function at each location to maintain the end panel 12 in abutment with end bell 36 and fixedly mounted to the end panel mounting bracket assembly 40, the stud 54 projecting through a hole of corresponding diameter within panel 12.

As may be appreciated by reference to FIGS. 2, 3 and 4, since the U-bolts 50 have their legs spaced a distance approximately equal to the diameter of the head bolt bolt heads 38*a* and since the cut outs 52 within the walls of the saddle member 46 are approximately of the same diameter, they complete a circular cavity, when the U-bolts are mounted to the saddle member 46. U-bolt 50 surrounds a portion of the head 38*a* and it is relatively easy to tighten down on the clamp 44 formed thereby, by tightening nuts 62 threaded to respective threaded ends 50*a* of the U-bolt 50.

Relatively large compressive forces are exerted on the bolt heads 38*a*, frictionally locking each end panel mounting bracket assembly 40 to a pair of adjacent bolt heads 38*a* between which spans the angle bar or bracket member 42. As may be appreciated, the cut outs 52 within the sidewalls of the U-shaped saddle member 46 as well as the U-bolts 50 contact the corners of the hexagonal bolt heads 38*a* such that the corners bite into these members to effect an excellent mechanical grip between the mounting bracket assembly 40 and the bolt heads 38*a*. However, the assembly shown in FIGS. 2 through 4 inclusive requires close correspondence in size between the saddle member 46, particularly with respect to the cut outs 52, as well as the curved portion of U-bolt 50 and diameter of bolt heads 38*a*, to which these members are clamped.

In an effort to provide an end panel mounting bracket assembly capable of being used with a variety of bolt heads, i.e., bolts of different sizes, in FIG. 5, a split ring spacer 64 which includes a gap at 64*a* is interposed between the bolt head 38*a* and saddle member 46 and U-bolt 50. This permits the split ring spacer 64 to be compressed slightly, that is, have its diameter reduced, while normally tending to expand such that its outer periphery in contact the cut outs 52 of saddle member 46 and the rounded portion or base 50*b* of the U-bolts 50, these elements corresponding exactly to that of the embodiment previously discussed.

Other variations may be readily had. For instance, by reference to FIG. 7, an offset cast saddle or saddle member is shown at 46′, being formed of a single planar portion or wall 66 which joins tubular portions 68 on either end thereof. Wall 66 includes a circular cut out 70 along one edge, the cut out 7 cooperating with a U-bolt as at 50 similar to the embodiment of FIG. 1, with the offset cast saddle 46′ being simply substituted for the U-shaped bent sheet metal saddle 46 illustrated in FIG. 6.

Further, instead of an angle arm bar or bracket member having right angle portions, i.e., a relatively thin base and thin flange portion, as at 42*a* and 42*b*, respectively, in the embodiment of FIGS. 2, 3 and 4, a solid parallelepiped metal bar 72 may be employed. In FIG. 8, the bar 72 bears four drilled holes, is of some thickness and saddle members 46 are readily mounted thereto, the saddle members 46 receiving the U-bolts 50 to which nuts 62 are threaded to their threaded ends 50*a* projecting through the holes. The metal bar 72 forms a solid bar, bracket member in this embodiment. As may be appreciated, an offset cast saddle member 46′ may be employed, at each end, rather than U-shaped bent sheet metal saddle members 46.

With respect to the embodiment of FIG. 8, the bar member 72 is provided with a tapped hole as at 82, in the embodiment shown at the center thereof, which receive a screw such as a screw 14 with or without a washer 16 interposed between the head of the screw and the insulation panel 12. This permits mounting of the panel 21 directly to the end panel mounting bracket assembly 40′. As may be appreciated, utilizing the bracket assembly of the embodiment of FIG. 8 in the environment of FIG. 1, would require four such bracket assemblies for mounting the two panel sections or halves 18 and 20.

Referring next to FIG. 9, a further embodiment of the end panel bracket assembly 40″ is shown, the assembly also utilizing a solid bar 72′ as the bracket member. However, in this case, cable or loop clamps 76 are employed at each end of the bar 72′, and loop about or surround the bolt heads 38*a*. They have holes drilled through their ends 76*a*, with a similar sized holes drilled through bar 72′, through which project bolts 78 bearing nuts 80 on the opposite ends thereof. The looped clamps 76 are sized to the bolt heads 38*a* so as to tightly, frictionally grip the bolt heads when the nuts 80 are tightened down on the mounting bolts 78 for bar 72′. The bar 72′ bears a tapped and threaded hole 82, in similar fashion to that of the embodiment of FIG. 8, to directly receive a screw such as screw 14, FIG. 4.

FIGS. 10 and 11 show another embodiment of the present invention in which case an end panel mounting bracket assembly 40‴ is employed at a number of locations spanning two bolt heads but mounted to a singular one of the bolt heads 38*a*, functioning to mount the end bell 36 to the end of drum 10. Assembly 40‴ employs in addition to bar 72″, a sheet metal locater plate 84 having a circular cut out 86 at one end and within the plate proper. At its opposite end, within edge 84*a*, a semi-circular cut out 88 is sized slightly larger than the diameter of bolt head 38*a*. The bar 72″ is obliquely welded to the sheet metal plate 84, at some angle X, as indicated. The bar 72″ is provided, in turn, with a semi-circular cut out as at 90, corresponding to the diameter of the bolt head 38*a*, and is also provided with laterally opposed right angle holes, adjacent the cut out 90, through which project legs 50*c* of a U-bolt 50. The ends 50*a* of the U-bolts are threaded in similar fashion to those of the prior embodiments, and these ends bear nuts 92 for tightening the U-bolt down and frictionally gripping the bolt head via the bar 72″ and U-bolt 50.

In a different manner from the prior embodiments, the end panel mounting bracket assembly 40''' provides one or more "stud points" (represented by studs 94 and 96) that can orbit around the bolt head 38*a* as the assembly is rotated. This allows greater flexibility in mounting of the end panel 12 to the drum 10, provides for mounting other items, as well, by furnishing an additional stud per head bolt location. With the locater plate 84 having a round hole 86 which closely fits and surrounds the bolt head 38*a* to the right, FIG. 11, and a semi-circular cut out or opening 88 within edge 84*a*, at the opposite end of the sheet metal locater plate 84, which closely fits a second bolt head 38*a* immediately adjacent and to the left of the bolt head 38*a* projecting through hole 86, it may be appreciated that the center of hole 86 and the center of the semi-circular recess 88 correspond with the exact centers of the adjacent bolt heads 38*a*, FIG. 11. Further bar 72'' and the locater plate 84 are fixed to one another at the predetermined angle X so that when the assembly of the sheet metal plate and bar 72' are relocated to any other pair of bolts on the dryer head, the location of the radially dissimilar stud points defined by studs 94 and 96 will always be at the same distance relative to the center C of the drum end bell.

As may be appreciated, a multiplicity of assemblies 40''' set on the dryer head bolts 38 will then provide a series of mounting points defined by studs 94, all at the same radius from the dryer center C, and similarly, a series of different mounting points defined by studs 96, which are all at the same radius, but another radius from the dryer center C. It follows then, that, since the dryer head bolts are equally spaced in a given bolt circle, one can accurately predict the location of the mounting points for a dryer drum insulation end panel 12 or other appropriate device.

As may be appreciated, the embodiment of FIGS. 10 and 11 constitutes a bracket, which bracket mounts or spans between a pair of laterally circumferentially adjacent bolt heads 38*a*.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An end panel mounting bracket assembly for mounting a planar thermal insulation panel onto an exposed end of a paper dryer drum or the like, said drum comprising an elongated metal cylinder, dryer head end bells carried on respective ends of said cylinder and being bolted thereto by a plurality of drum head bolts at spaced circumferential positions along said end bells and with the bolt heads at spaced circumferential positions along said end bells and with the bolt heads projecting from the face of the end bells, said mounting bracket assembly comprising:

an elongated bracket member separate from said insulation panel and spanning between two spaced bolt heads to define at least one accurate panel fixing point delimited by both of said bolt heads, at least one clamp member fixed to said bracket member and surrounding one of said bolt heads and being frictionally clamped thereabout, and means for detachably fixedly mounting said panel within the end of said cylinder and to one of said members, overlying said members and spanning across the end of said cylinder.

2. The end panel mounting bracket assembly as claimed in claim 1, wherein said bracket member comprises an angle bar extending beyond said bolt head and comprising a base and an integral right angle flange portion, said base being longer than the distance between said bolt heads, said flange portion being at the center of said angle bar and of a length less than the distance between said bolt heads and being interposed therebetween, said at least one clamp member comprising a pair of clamps carried by said base to opposite sides of said flange portion for engaging respective bolt heads of said end belt, a stud fixedly mounted to said angle bar and projecting outwardly of said flange portion at right angles thereto for projection through said panel, and screw means threaded to the end of said stud remote from said flange portion for locking said panel on said stud to the bracket member.

3. The end panel mounting bracket assembly as claimed in claim 1, wherein said bracket member comprises an elongated, parallelepiped metal bar having a length in excess of the distance between said spaced bolt heads, and wherein said at least one clamp member comprises a pair of clamps mounted to said bar and frictionally gripping respective bolt heads at respective ends of said bar, and wherein said bar includes at least one tapped hole therein and a screw threaded to said tapped hole and project through said end panel into said bar for fixing said end panel to the face of said bar bearing said tapped hole.

4. The end panel mounting bracket assembly as claimed in claim 1 wherein said at least one clamp member comprises a clamp including a saddle member bearing an arcuate recess within an edge thereof opposite an edge thereof in contact with said elongated bracket member and a U-bolt borne by said saddle member projecting therethrough and through said elongated bracket member, said U-bolt having threaded ends, and nuts threaded to the ends of said U-bolt projecting through said elongated bracket member such that said bolt head is gripped by the arcuate recess within said saddle member and a curved portion of said U-bolt to frictionally lock said bracket member to said bolt head.

5. The end panel mounting bracket assembly as claimed in claim 3 wherein said at least one clamp member comprises a clamp including a saddle member bearing an arcuate recess within an edge thereof opposite an edge thereof in contact with said elongated bracket member and a U-bolt borne by said saddle member projecting therethrough and through said elongated bracket member, said U-bolt having threaded ends, and nuts threaded to the ends of said U-bolt projecting through said elongated bracket member such that said bolt head is gripped by the arcuate recess within said saddle member and a curved portion of said U-bolt to frictionally lock said bracket member to said bolt head.

6. The end panel mounting bracket assembly as claimed in claim 4, further comprising a split ring spacer interposed between said bolt head, said U-bolt and said saddle member, thereby spacing said U-bolt and said saddle member from said bolt head and conforming generally to the gap therebetween to permit said end panel mounting bracket assembly to be mounted to bolt heads of given diameter.

7. The end panel mounting bracket assembly as claimed in claim 1, wherein said elongated bracket member comprises a sheet metal locator plate bearing a circular hole within one end thereof sized to the diameter of said one bolt head and receiving said one bolt head, said sheet metal locator plate terminating at the end opposite that bearing the circular hole in an edge bearing a semi-circular recess sized to the diameter of another bolt head and receiving a portion of said other bolt head, a metal bar fixedly mounted to said sheet metal locater plate at an angle thereto and bearing a semi-circular recess corresponding to said hole within said locater plate and being aligned therewith such that said semi-circular hole within said bar receives, along with said hole within said locater plate, a portion of said one bolt head, a U-bolt mounted to said bar and including a curved base portion aligned with the semi-circular hole within said bar and having legs projecting through said bar to opposite sides of said semi-circular hole and terminating in threaded ends, nuts borne by said threaded ends, so as to clamp the U-bolt and the bar to said one bolt head, and a pair of studs fixedly mounted to said bar on a face thereof and axially parallel with the semi-circular hole therein and projectable through holes within said end panel and functioning in conjunction with said sheet metal locater bar to fix mounting holes at two different radial positions within said end panel at a position determined by the dryer head bolts carried by said paper dryer drum.

8. The end panel mounting bracket assembly as claimed in claim 1, wherein said elongated bracket member comprises a metal bar of parallelepiped form having a length less than the distance between said spaced bolt heads, said bar having holes therethrough at opposite ends thereof, metal strip loops surrounding respective bolt heads and having ends projecting therefrom, holes within respective ends of said strip, said loop strip being bolted via said holes therein to respective ends of said bar for frictional gripping of bolt heads to respective sides thereof, and a tapped and threaded hole within said bar intermediate of its ends at right angles to said holes bearing said bolts and nuts and on the face facing away from the ends of said bolt heads, and a screw threaded to said tapped and threaded hole and projecting through said end panel for pressing said end panel against the face of said bar to fixedly lock said end panel to said dryer head end bell.

* * * * *